US012480277B2

(12) United States Patent
Hodel et al.

(10) Patent No.: US 12,480,277 B2
(45) Date of Patent: Nov. 25, 2025

(54) SYSTEMS AND METHODS FOR CONTROLLING A DIGGING AND DUMPING MACHINE

(71) Applicant: Caterpillar Inc., Peoria, IL (US)

(72) Inventors: Benjamin J. Hodel, Dunlap, IL (US); Adam M. Nackers, Washington, IL (US); Justin Lee Steinlage, Mackinaw, IL (US); Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 272 days.

(21) Appl. No.: 18/319,371

(22) Filed: May 17, 2023

(65) Prior Publication Data

US 2024/0384501 A1 Nov. 21, 2024

(51) Int. Cl.
*E02F 3/43* (2006.01)

(52) U.S. Cl.
CPC ..... *E02F 3/439* (2013.01)

(58) Field of Classification Search
CPC . E02F 3/439; E02F 3/437; E02F 9/205; E02F 9/262; E02F 3/438; E02F 9/2037; E02F 9/2041; E02F 9/2045; E02F 9/264; E02F 9/261; E02F 5/025; B60W 2300/17; G06Q 50/08
See application file for complete search history.

(56) References Cited

U.S. PATENT DOCUMENTS 6,157,889 A 12/2000 Baker
6,363,173 B1 * 3/2002 Stentz ..... G06V 20/64 382/153
6,363,632 B1 4/2002 Stentz et al.
6,502,016 B1 * 12/2002 Ozaki ..... G05D 1/0259 73/178 R
9,529,964 B2 12/2016 Hagenbuch et al.
11,047,109 B2 6/2021 Frank
11,111,647 B2 * 9/2021 Ready-Campbell .... E02F 9/205
2012/0095640 A1 * 4/2012 Lehtinen ..... E02F 3/434 701/25
2012/0130599 A1 * 5/2012 Faivre ..... E02F 9/265 701/50
2012/0136523 A1 * 5/2012 Everett ..... E02F 9/2054 701/24
2012/0191431 A1 7/2012 Dunbabin et al.
2013/0173109 A1 * 7/2013 Hukkeri ..... G05D 1/0891 701/23
2014/0214235 A1 * 7/2014 Kini ..... E02F 9/205 701/2

(Continued)

FOREIGN PATENT DOCUMENTS

WO 2022157089 A1 7/2022

*Primary Examiner* — Fadey S. Jabr
*Assistant Examiner* — Faris Asim Shaikh

(57) ABSTRACT

A control system for a machine includes a machine body, a linkage assembly, a bucket coupled to the machine body via the linkage assembly, a user interface remote from the machine body, and a controller in communication with the user interface. The controller is configured to receive one or more signals defining a dump region. The dump region includes a front-most end point and a rear-most end point. The controller is also configured to receive one or more signals defining a dump order or dump specification and initiate an autonomous digging and dumping procedure.

20 Claims, 4 Drawing Sheets

(56) References Cited

U.S. PATENT DOCUMENTS

| | | | | |
|---|---|---|---|---|
| 2014/0261152 | A1* | 9/2014 | Tanaka | E02F 9/265<br>116/230 |
| 2014/0316665 | A1* | 10/2014 | Hargrave, Jr. | E02F 9/261<br>340/436 |
| 2014/0371947 | A1* | 12/2014 | Stratton | G01C 7/04<br>701/1 |
| 2015/0376869 | A1* | 12/2015 | Jackson | E02F 9/2054<br>701/2 |
| 2016/0054114 | A1* | 2/2016 | Crozier | G01S 17/88<br>702/151 |
| 2017/0114519 | A1* | 4/2017 | Hague | G05B 19/402 |
| 2018/0088591 | A1* | 3/2018 | Friend | G05D 1/0291 |
| 2018/0135277 | A1* | 5/2018 | Tsuji | E02F 9/262 |
| 2020/0283993 | A1* | 9/2020 | Minagawa | E02F 9/205 |
| 2021/0002852 | A1* | 1/2021 | Nishi | E02F 9/2282 |
| 2021/0353381 | A1* | 11/2021 | Usui | A61B 90/50 |
| 2024/0200303 | A1* | 6/2024 | Kim | E02F 3/434 |

* cited by examiner

SYSTEMS AND METHODS FOR CONTROLLING A DIGGING AND DUMPING MACHINE

TECHNICAL FIELD

This disclosure relates generally to a digging and dumping machine and a transport vehicle, and more particularly to systems and methods of controlling the digging and dumping machine, under remote control or autonomous operation, relative to a transport vehicle.

BACKGROUND

Machines are used for moving material between locations or onto transport vehicles at a work site. For example, rope shovels, mining shovels, hydraulic shovels, and hydraulic excavators may move material using rotational movement while transport vehicles or material carrying machines, such as haul trucks, may be loaded with the material, and then move the material by driving along a path or road. Machines using such rotational capabilities may dig material with a material engaging work implement at a dig site and rotate the work implement to a dump or truck load site, at which the work implement is dumped or unloaded into a transport vehicle, such as a haul truck. The transport vehicle may then be propelled to another location, at which the material is dumped or discharged from the machine. The process of moving material may be repeated numerous times in order to move the desired amount of material. Furthermore, positioning the material engaging work implement over one or more portions of the transport vehicle during the digging and dumping procedure may be manually intensive and/or time consuming. Additionally, material delivered from the material engaging work implement into the transport vehicle may be unevenly or disparately distributed on the bed of the transport vehicle.

International Publication No. WO2022/157089A1 to Kempf et al. ("the '089 application") discloses a method for operating a loading element for a vehicle having a loading area. The method of the '089 application includes determining a position of at least one unloading line on the loading area and a plurality of unloading points arranged on the at least one unloading line. The method of the '089 application then includes unloading a load contained in the loading element at the unloading points in order to load the loading area. However, the method of the '089 application may require additional costly autonomous systems and/or sensors, which may also be susceptible to failure or malfunctioning, for example, from dust or other material on the work site. Moreover, the method of the '089 application may not evenly distribute or otherwise appropriately deliver material from the loading element into the load area.

Aspects of the present disclosure may solve one or more of the problems set forth above and/or other problems in the art. The scope of the disclosure, however, is not defined by the ability to solve any specific problem.

SUMMARY OF THE DISCLOSURE

According to one aspect of the present disclosure, a control system for a machine may include a machine body, a linkage assembly, a bucket coupled to the machine body via the linkage assembly, a user interface remote from the machine body, and a controller in communication with the user interface. The controller may be configured to receive one or more signals defining a dump region, which may include a front-most end point and a rear-most end point. The controller may also be configured to receive one or more signals defining a dump order or dump specification and initiate an autonomous digging and dumping procedure.

In other aspects of this disclosure, a method of operating a machine with a bucket may include defining a dump region. Defining the dump region may include positioning the bucket in a rear-most end of the dump region, storing the position with the bucket in the rear-most end of the dump region, positioning the bucket in a front-most end of the dump region, and storing the position of the bucket in the front-most end of the dump region. The method may also include defining or selecting a dump order or dump specification. The method also may include initiating an autonomous digging and dumping procedure.

Furthermore, in yet other aspects of this disclosure, a digging machine may include a machine body, a linkage assembly, a bucket movably coupled to the machine body via the linkage assembly, at least one perception system on the digging machine, and a controller in communication with the at least one perception system. The perception system may be positioned on the linkage assembly. The controller may be configured to receive one or more signals defining a dump region. The dump region may include a forward-most end point and a rear-most end point. Receiving one or more signals defining the dump region may include positioning the bucket in a rear-most end of the dump region and positioning the bucket in a forward-most end of the dump region. The rear-most end point of the dump region may be spaced from a rear-most end of a bed of a haul truck by an offset. The controller may also receive one or more signals defining a dump order or dump specification. The controller may initiate an autonomous digging and dumping procedure.

BRIEF DESCRIPTION OF THE DRAWINGS

The accompanying drawings, which are incorporated in and constitute a part of this specification, illustrate various exemplary embodiments, and together with the description serve to explain the principles of the disclosed embodiments.

DETAILED DESCRIPTION

Figure 1A:
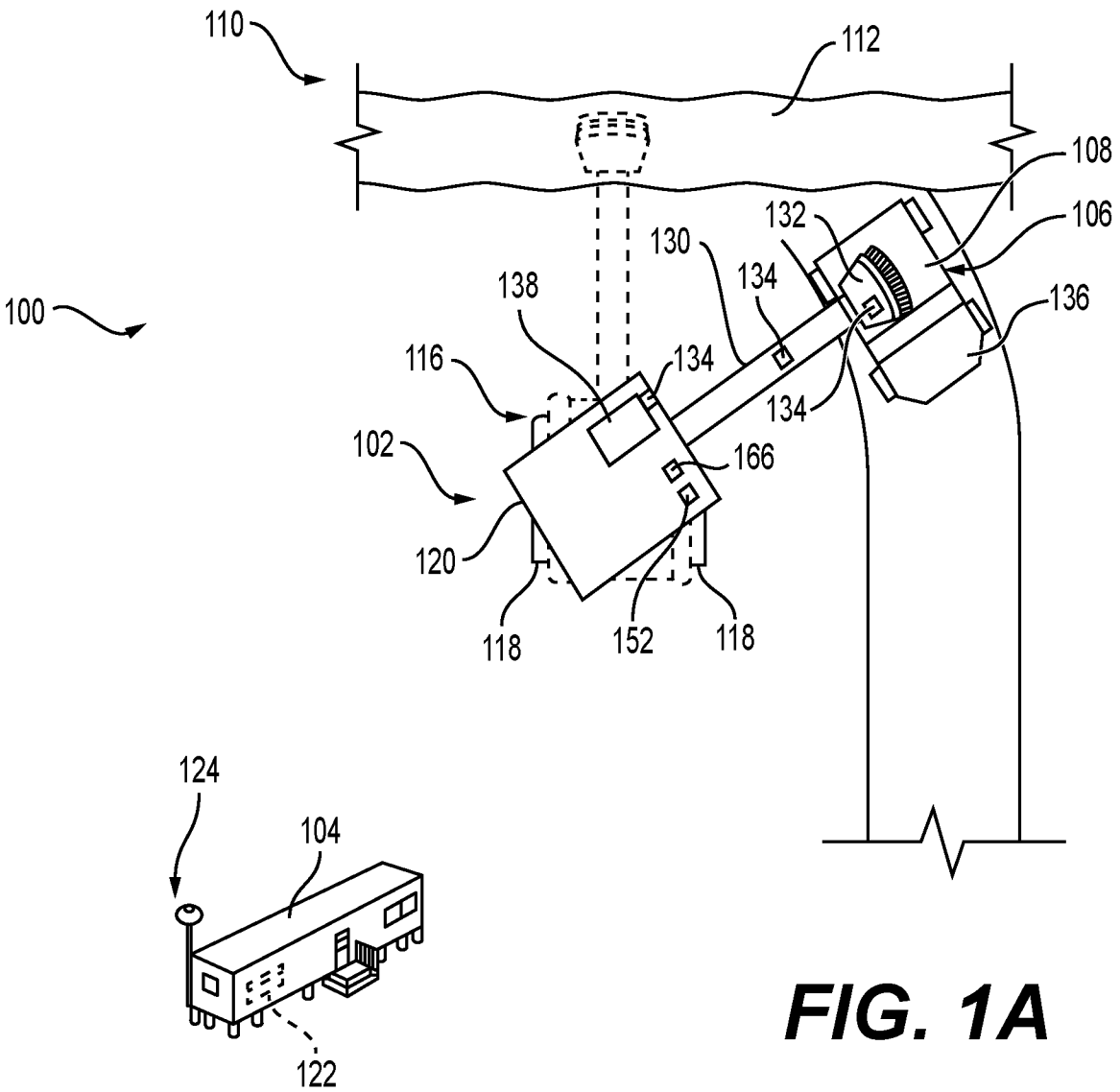
FIG. 1A illustrates an exemplary system, including a digging machine, a transport vehicle, and a remote control site on a work site.

Reference will now be made in detail to specific embodiments or features, examples of which are illustrated in the accompanying drawings. Generally, corresponding or similar reference numbers will be used, when possible, throughout the drawings to refer to the same or corresponding parts. Features in the drawings may not be drawn to scale, but may rather be drawn to highlight different aspects of the disclosure. In this disclosure, relative terms, such as, for example, "about," "generally," and "substantially" are used to indicate a possible variation of ±10% in a stated numeric value.

FIG. 1A illustrates an exemplary excavation or digging system 100, which includes a machine 102 and a remote control site 104. Remote control site 104 may be controlled by one or more operators, for example, at a remote control station or operator station 122 (e.g., a remote control console), to operate machine 102 on a work site 110. In some aspects, remote control site 104 may include a wireless communication system 124, which may allow remote control site 104 to be in wireless communication with one or more aspects of machine 102. Machine 102 may be a digging machine, for example, an excavator (e.g., a hydraulic excavator), a rope shovel, a mining shovel, a hydraulic shovel, etc. Machine 102 may move material from a dig site 112 on work site 110 to one or more transport vehicles, for example, haul trucks 106 or other transport vehicles. For example, as discussed in detail below, one or more of portions of machine 102 and/or haul truck 106 may be positioned such that machine 102 loads material from work site 110 into a bed 108 of haul truck 106. With haul truck 106 positioned in proximity to machine 102, one or more operators (e.g., via remote control site 104) may control one or more portions of machine 102 to define a dump region, for example, within a portion of bed 108 of haul truck 106. After the operator(s) define the dump region, machine 102 may perform an automated digging and dumping procedure. Work site 110 may be a portion of, for example, a construction site, a road work site, a quarry, a mine site, a landfill, or any other type of work site.

As discussed in detail below, one or more operators at remote control site 104 may remotely operate machine 102, for example, via a non-line-of sight ("non-LOS") control or via a line-of-sight ("LOS") control (e.g., remote from machine 102 but within sight of machine 102). Moreover, the one or more operators at remote control site 104 may perform one or more operations to define a dig region. As mentioned above and as discussed in detail below, the one or more operators may also define the dumping region (e.g., at least a portion of bed 108 of haul truck 106). Based on the operator input, machine 102 may autonomously perform the digging and dumping procedure. As discussed herein, autonomously performing one or more procedures includes both fully autonomous performance and partially or semi-autonomous performance (e.g., some aspects of the procedure being done autonomously and some aspects of the procedure being done by an operator and/or under operator oversight or review). The digging and dumping procedure may continue for a predetermined amount of time, a predetermined number of digs, until a predetermined amount (e.g., volume, weight, etc.) of material has been moved, or until there are one or more error or warning conditions, other notification(s), etc.

Machine 102 includes an undercarriage 116, for example, including one or more ground engaging elements or tracks 118. Machine 102 also includes a machine body 120, which may be rotatable relative to undercarriage 116. Moreover, machine 102 includes a linkage assembly 130, for example, coupling a work implement or bucket 132 to machine body 120. Linkage assembly 130 may include one or more booms and sticks, such that linkage assembly 130, and thus bucket 132, is movable relative to machine body 120. Linkage assembly 130 and/or bucket 132 may be movable via respective hydraulic cylinder(s). As discussed here, various aspects of machine 102 may be movable or otherwise controlled, both via remote operator control and via autonomous control, to perform various digging or earth moving operations.

Furthermore, machine 102 may include one or more perception systems 134, for example, positioned on one or more portions of machine body 120 or otherwise on machine 102, which may help the remote operator control, for example, in non-LOS control. The one or more perception systems 134 may include one or more cameras (e.g., monocular cameras), one or more light detection and ranging systems (LIDAR), one or more stereo camera systems, etc. The one or more perception systems 134 may be positioned on one or more portions of machine body 120 (e.g., on or in front of a cab 138 or forward portion of machine body 120, with bucket 132 and/or linkage assembly 130 in a field of view), on one or more portions of bucket 132, on one or more portions of linkage assembly 130, or on one or more other portions of machine 102. In some aspects, the one or more operators may visually determine or estimate a position (e.g., pose, orientation, etc.) of one or more haul trucks 106 relative to machine 102, for example, based on images or video obtained by the one or more perception systems 134. In some aspects, perception system(s) 134 may obtain sensor data (e.g., image data) and/or process sensor data to extract or otherwise determine an estimate of a position (e.g., pose, orientation, etc.) of one or more haul trucks 106 relative to machine 102. The one or more perception system(s) 134 may also provide the sensor data to the one or more operators, for example, to be displayed on a display 126 on or in operator station 122 (FIG. 1B).

Additionally, machine 102 includes a controller 152, for example, in communication with operator station 122 via wireless communication system 124. In these aspects, as shown in FIG. 1B, controller 152 is a part of a control system 150. Controller 152 may be coupled to one or more sensors, control systems, actuators, etc., in order to help control the position of bucket 132 relative to machine body 120 and/or also control the position of machine body 120 relative to undercarriage 116. Controller 152 may receive one or more inputs, and emit one or more outputs, for example, to help position bucket 132 and/or machine body 120. Furthermore, controller 152 may receive one or more operator inputs, for example, during the remote operator control. Controller 152 may also emit one or more outputs during the autonomous control to help control the position and/or operation of machine body 120, linkage assembly 130, bucket 132, etc. Additionally, controller 152 may be in communication with perception system(s) 134. In these aspects, controller 152 may receive one or more inputs from perception system(s) 134, and emit one or more outputs to perception system(s) 134, for example, to help spot and/or position one or more haul trucks 106 and/or to define the dumping region in bed 108 of haul truck(s) 106.

Figure 1B:
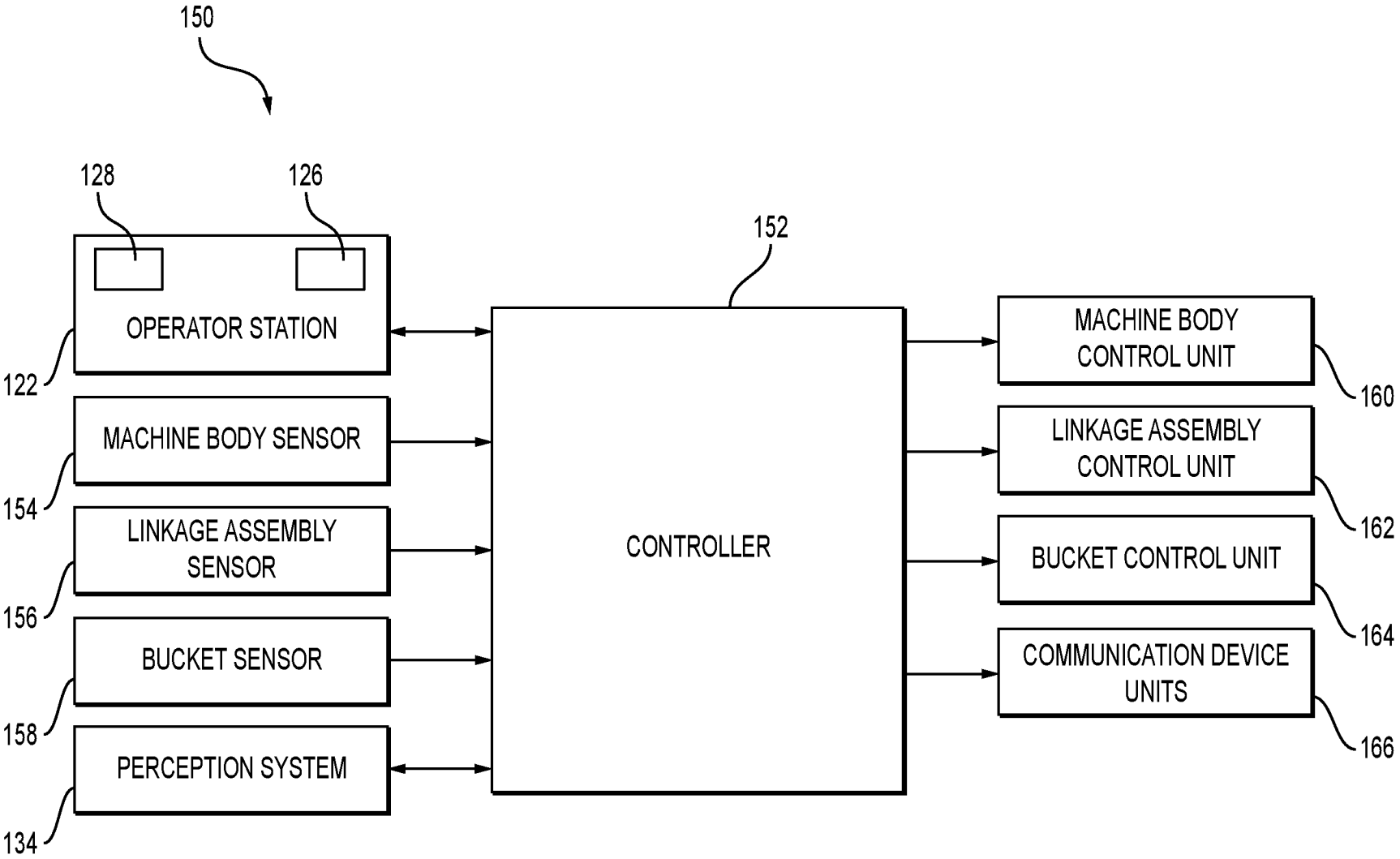
FIG. 1B illustrates an exemplary control system.

For example, as shown in FIG. 1B, control system 150 includes controller 152, which may receive one or more inputs from the one or more operators at operator station 122. Controller 152 may include control logic and/or instructions for both remote operator control and autonomous control. Alternatively or additionally, in some aspects, controller 152 may receive one or more inputs to control autonomous control operation, for example, autonomous control inputs from an autonomy or autonomous control electronic control module. Although not shown, the autonomy or autonomous control electronic control module may be incorporated in controller 152 or may be separate from controller 152.

Additionally, machine 102 may include a plurality of sensors in communication with controller 152. For example, machine 102 may include a machine body sensor 154, for example, configured to detect and/or provide information regarding the position of machine body 120 relative to undercarriage 116 and/or the pitch and/or roll of machine body 120, for example, relative to an inertial frame. Machine 102 may also include one or more linkage assembly sensors 156, for example, configured to detect and/or provide information regarding the position of one or more portions of linkage assembly 130 relative to machine body 120. Additionally, machine 102 may include one or more bucket sensors 158, for example, configured to detect and/or provide information regarding the position and/or orientation of one or more portions of bucket 132, for example, relative to linkage assembly 130 and/or machine body 120. One or more of machine body sensor 154, linkage assembly sensor(s) 156, and/or bucket sensor(s) may be inertial measurement units (IMUs), hydraulic cylinder displacement sensors, joint angular sensors, and/or other appropriate sensors to measure the position and/or orientation of respective portions of machine 102.

Controller 152 may also be in communication with one or more control units in control system 150. For example, controller 152 may be in communication with a machine body control unit 160, for example, configured to control a position of machine body 120 relative to undercarriage 116. Controller 152 may be in communication with a linkage assembly control unit 162, for example, configured to control a position of one or more portions of linkage assembly 130 relative to machine body 120. Additionally, controller 152 may be in communication with a bucket control unit 164, for example, configured to control a position of one or more portions of bucket 132 relative to linkage assembly 130 and/or machine body 120. In these aspects, control system 150 and controller 152 may help to control the position and/or operation of machine 102, for example, machine body 120, linkage assembly 130, and/or bucket 132, when operating in a remote control operation mode and/or when operating in an autonomous control mode. For example, control system 150 may receive inputs and emit outputs to control the operation of machine body 120, linkage assembly 130, and/or bucket 132 to dig, dump, or otherwise move material from work site 110, for example, to bed 108 of one or more haul trucks 106, when operating in the remote control operation mode and/or when operating in the autonomous control mode. Furthermore, as discussed herein, control system 150 may receive one or more inputs or signals when operating in the remote control operation mode in order to establish operating parameters for when operating in the autonomous control mode, for example, including the dumping region.

Additionally, as shown in FIG. 1B, operator station 122 may include one or more displays 126 and one or more user interfaces 128. Display(s) 126 may receive signals (e.g., video or image signals) from perception system(s) 134 or other sensors on or near machine 102. Display(s) 126 may be in communication with perception system(s) 134 or other sensors via controller 152, for example, to display one or more images or videos obtained by perception system(s) 134. In these aspects, the operator may signal machine 102 to perform one or more operations, for example, via one or more user interface(s) 128 based on the operator's observances via perception system(s) 134 and display(s) 126. Additionally, the operator may signal, via controller 152, one or more communication device units 166 on machine 102, for example, to provide one or more signals to haul truck 106. In these aspects, the operator may signal one or more communication device units 166 to emit one or more audible signals (e.g., honk or otherwise operate a horn or other audible device on machine 102), one or more visible signals (e.g., illuminate, flash, or otherwise operate one or more lights on machine 102), etc. Moreover, as discussed in detail below, the operator may control one or more aspects of machine 102, for example, via user interface(s) 128. In these aspects, the operator may position one or more of machine body 120, linkage assembly 130, and/or bucket 132 to define a dumping region, for example, in one or more portions of bed 108 of haul truck 106. With the dumping region defined, machine 102 may autonomously (e.g., fully autonomously or partially or semi-autonomously) perform one or more digging and dumping procedures.

Although not shown, controller 152 may be coupled to or include one or more memory units, which may contain instructions for controller 152 to help control a position or movement of one or more of machine body 120, linkage assembly 130, and/or bucket 132. Controller 152 may also be coupled to or include one or more memory units, which may contain instructions for controller 152 to help operate and/or analyze data from perception system(s) 134. Controller 152 may be a separate controller on machine 102, or may be integrated into a central vehicle controller (e.g., a main power controller, an operation controller, etc.). Alternatively, controller 152 may be integrated into one or more of control or management systems or modules (e.g., for operating the engine) of machine 102, or another dedicated control module on machine 102. In one aspect, machine 102 may be an electrohydraulic excavator, and controller 152 may control one or more electrical switches or valves in order to control one or more hydraulic cylinders or electrical elements in order to operate machine 102.

Controller 152 may include one or more microprocessors. For example, controller 152 may embody a single microprocessor or multiple microprocessors. The one or more microprocessors of controller 152 may be configured to perform any of the operations mentioned herein. For example, controller 152 may include a memory, a secondary storage device, a processor, such as a central processing unit or any other means for accomplishing a task consistent with the present disclosure. The memory or secondary storage device associated with controller 152 may be non-transitory computer-readable media that store data and/or software routines that may assist controller 152 in performing its functions, such as the functions of process or method 400 of FIG. 4, as discussed below. Further, the memory or secondary storage device associated with controller 152 may also store data received from the various inputs or sensors associated with machine 102. Numerous commercially available microprocessors can be configured to perform the functions of controller 152. It should be appreciated that controller 152 could readily embody a general machine controller capable of controlling numerous other machine functions. Various other known circuits may be associated with controller 152, including signal-conditioning circuitry, communication circuitry, hydraulic or other actuation circuitry, and other appropriate circuitry.

Figure 2:
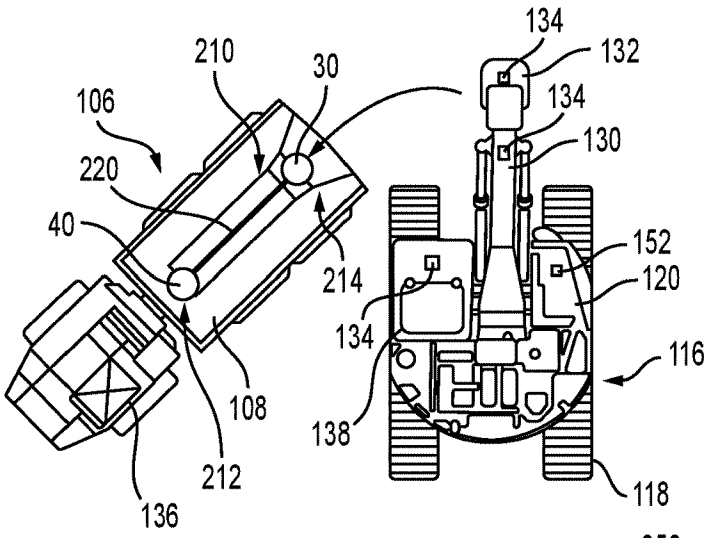
FIG. 2 is a top view of the digging machine and the transport vehicle of FIG. 1A.

FIG. 2 is a top view of machine 102 and haul truck 106, with machine 102 defining a dump region 210. For example, the one or more operators (e.g., at remote control site 104 in FIG. 1A) may define dump region 210. For example, using one or more perception system(s) 134 of other sensors on machine 102 or using LOS control, the one or more operators may control machine body 120, linkage assembly 130, and/or bucket 132 (e.g., via controller 152 and one or more of machine body control unit 160, linkage assembly control unit 162, and bucket control unit 164), such that bucket 132 is positioned at or above one or more (e.g., two or more) points on the work site 110 (e.g., above portions of haul truck 106) to define dump region 210. Alternatively, the one or more operators may be remote from machine 102 and control machine body 120, linkage assembly 130, and/or bucket 132, as discussed above, in non-LOS remote operation, for example, using the one or more perception systems 134 or other sensors on machine 102. In either aspect, as mentioned, dump region 210 may be bed 108 of haul truck 106, for example, along a midline 220 of bed 108 of haul truck 106 (as shown). In these aspects, the one or more operators may position a portion (e.g., a heel) of bucket 132 at or above one or more locations on work site 110. In one aspect, the one or more operators may control machine body 120, linkage assembly 130, and/or bucket 132, such that a portion of bucket 132 is at or above one end (e.g., a rear portion) of bed 108 of haul truck 106, for example, point 30 in FIG. 2. For example, the one or more operators may position machine body 120, linkage assembly 130, and/or bucket 132 to the desired dump edge or end position 214 (e.g., a first boundary), and may input one or more indications or selections to set the position as the edge or end position or boundary for dump region 210. The one or more indications or selections may include depressing one or more buttons (e.g., on a joystick), entering one or more commands on a keyboard or touch screen, etc.

Moreover, the one or more operators may control machine body 120, linkage assembly 130, and/or bucket 132 such that a portion of bucket 132 is at or above another end (e.g., a front portion) of bed 108 of haul truck 106, for example, point 40 in FIG. 2. For example, the one or more operators may position machine body 120, linkage assembly 130, and/or bucket 132 to the desired dump edge or end position 212 (e.g., a second boundary), and may input one or more indications or selections to set the position as one edge or end position or boundary for dump region 210. The one or more indications or selections may include depressing one or more buttons (e.g., on a joystick), entering one or more commands on a keyboard or touch screen, etc.

In these aspects, controller 152 may store one edge or end position 212 and another edge or end position 214 of dump region 210, for example, into the memory of controller 152 or another memory (not shown) in control system 150. Controller 152 may also interpolate or extrapolate a pose or orientation of haul truck 106 and bed 108, and thus also interpolate or extrapolate dump region 210, for example, including a plurality of dump positions that span dump region 210. For example, dump region 210 may have a dump length and/or a dump width. In this aspect, for example, based on the number of dig paths, controller 152 may determine a number of loads or dumps. As discussed below with respect to FIGS. 3 and 4, controller 152 may determine a bucket position for the plurality of the dumps, such that the various dumps are spaced along the length of dump region 210.

Figure 3:
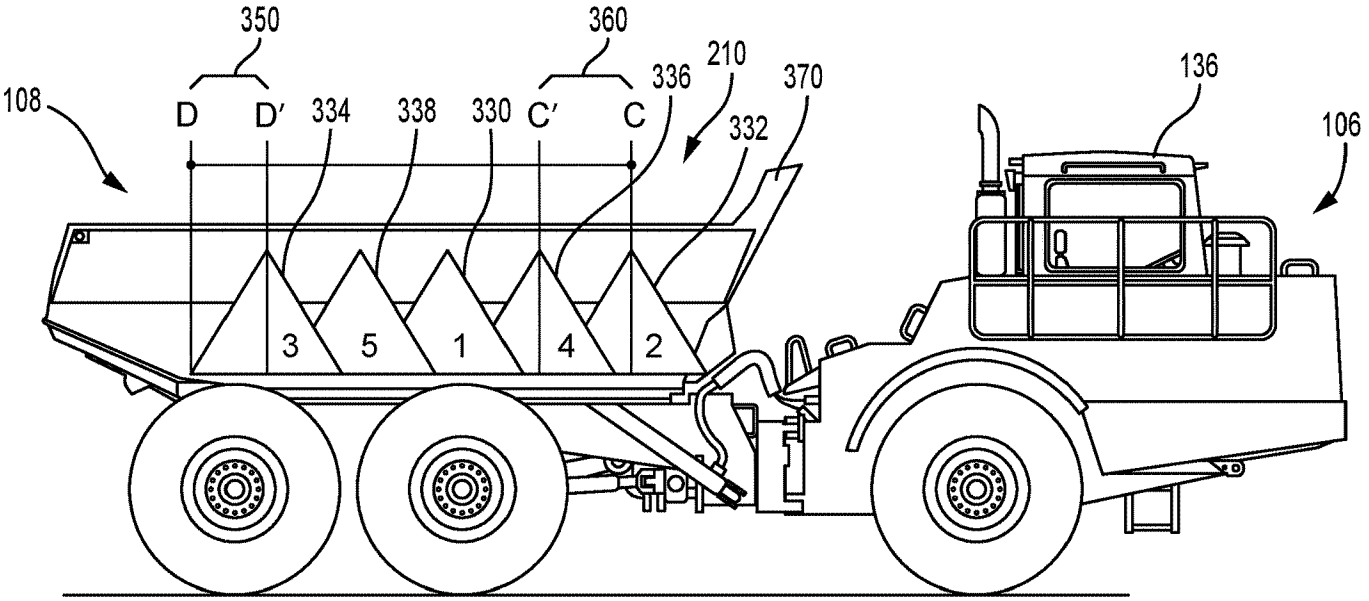
FIG. 3 is a side view of the transport vehicle of FIG. 1A with exemplary material dump locations in a dump region of a bed of the transport vehicle.

FIG. 3 is a side view of the transport vehicle of FIGS. 1A and 2 with exemplary material dump locations in dump region 210 in bed 108 of haul truck 106. As shown, dump region 210 may correspond to midline 220 (FIG. 2) of bed 108. Dump region 210 may include a forward-most dump position C, for example, corresponding to the defined front end position 212. Moreover, dump region 210 may include a rear-most dump position D, for example, corresponding to the defined rear end position 214. In some aspects, controller 152 may determine an offset 350 (e.g., a rear offset 350) from the defined rear end position, for example, an offset rear-most dump position D'. Rear offset 350 may help to avoid dumped material falling to the rear of bed 108 of haul truck 106. Additionally, in some aspects, controller 152 may determine another offset 360 (e.g., a front offset 360) from the defined front end position, for example, an offset front-most dump position C'. Front offset 360 may help to avoid dumped material falling to the front of bed 108 of haul truck 106 and/or to avoid dumped material falling onto cab 136 of haul truck 106. In some aspects, haul truck 106 may include an elevated truck wall 370, for example, at the front end of bed 108. If haul truck 106 includes elevated truck wall 370, then front offset 360 may not be necessary.

In some aspects, after the one or more operators define dump region 210, the operators(s) or controller 152 may position bucket 132 of machine 102 in a center of dump region 210 and dump dug material from bucket 132, for example, at a first dump position 330. Controller 152, for example, via other components of control system 150, may then perform an automated digging and dumping procedure. Controller 152 may perform the automated digging and dumping procedure after receiving one or more inputs from the operator(s), for example, via user interface 128. For example, controller 152 may signal one or more of machine body 120 (e.g., via machine body control unit 160), linkage assembly 130 (e.g., via linkage assembly control unit 162), and/or bucket 132 (e.g., via bucket control unit 164) such that bucket 132 is positioned at dig site 112 and performs a dig. Controller 152 may then signal one or more of machine body 120, linkage assembly 130, and/or bucket 132, such that bucket 132 is positioned over another portion of bed 108 of haul truck 106 (e.g., a second dump position 332) for another dump. Controller 152 may control machine 102 to perform one or more additionally digging and dumping cycles, for example, until bed 108 is full, has reached a load capacity, dig site 112 has been depleted, etc. As shown in FIG. 3 and as discussed below, controller 152 may determine the position of bucket 132 for second dump position 332 and subsequent dump positions (e.g., a third dump position 334, a fourth dump position 336, a fifth dump position 338, etc.) based on various operating parameters and/or operator selections. The dump positions may be spaced apart along midline 220 of bed 108. Alternatively, the dump positions may be staggered on either side (e.g., left or right) of midline 220 (FIG. 2), for example, for wider beds 108. Moreover, in some aspects and as discussed below, the dump positions may be spaced apart from front and/or rear ends of bed 108, for example, to help ensure that dumped material is retained in bed 108, and does not fall on the ground surface below or adjacent to bed 108 and/or does not fall on cab 136 of haul truck 106.

In some aspects, as shown in FIG. 3, first dump position 330 may be a center position of dump region 210, for example, midway between positions C and D', or between positions C' and D' if dump region 210 includes offset 360. Second dump position 332 may be a position at forward-most dump position C, and third dump position 334 may be a position at rear-most dump position D'. Fourth dump position 336 may be midway between first dump position 330 and second dump position 332. Fifth dump position 338 may be midway between first dump position 330 and third dump position 334. Further dump positions may be midway between previous dumps and/or on one or more sides (e.g., left or right) of midline 220 of bed 108. For example, although not shown, a sixth dump position may be midway between second dump position 332 and fourth dump position 336, and a seventh dump position may be midway between first dump position 330 and fourth dump position 336. Moreover, although not shown, an eighth dump position may be midway between first dump position 330 and fifth dump position 338, and a ninth dump position may be midway between third dump position 334 and fifth dump position 338. The midway or bisecting dump positions may help to distribute material on bed 108.

Figure 4:
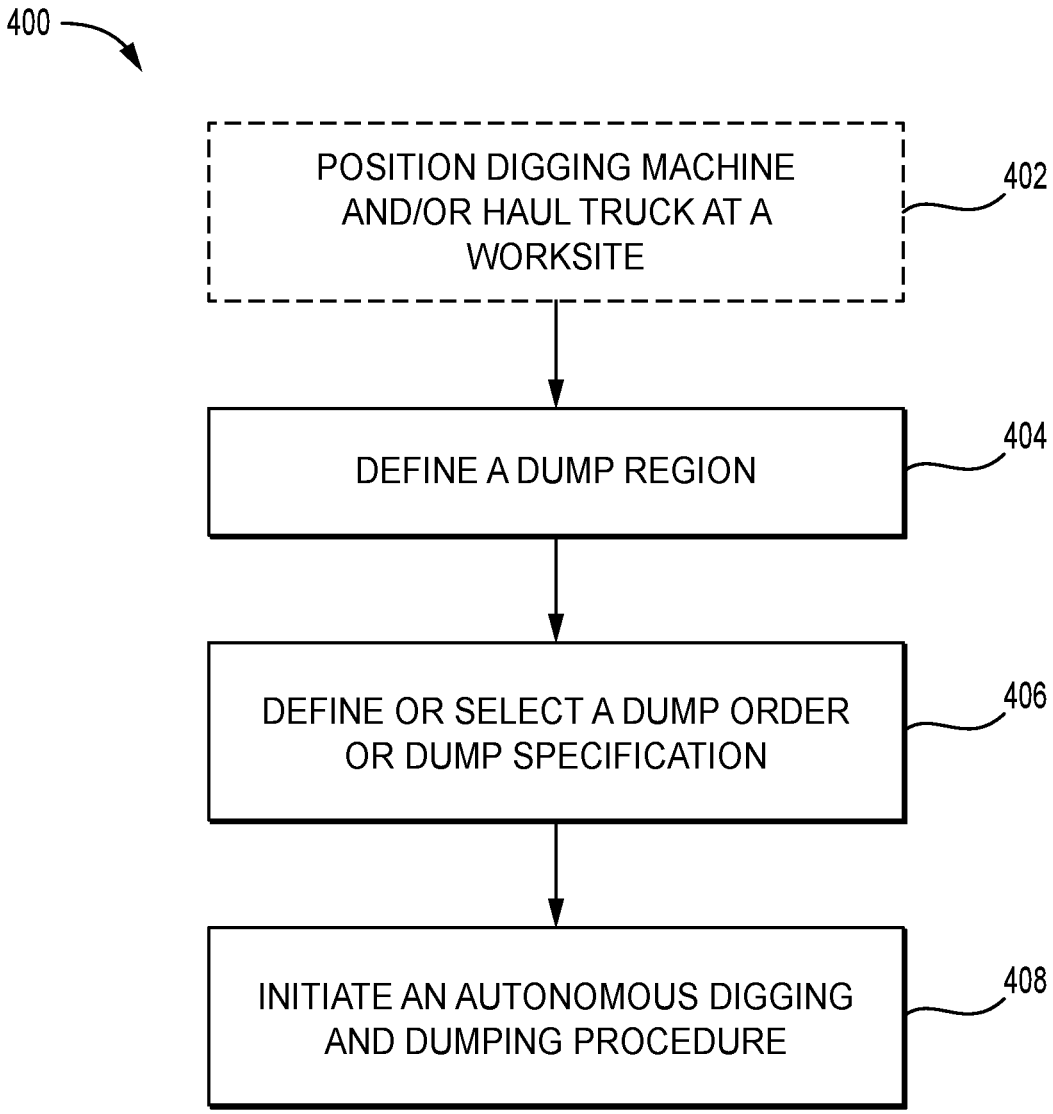
FIG. 4 is a method of operating the digging machine to define the dump region in the bed of the transport vehicle and initiate the digging and dumping process.

FIG. 4 illustrates an exemplary method or process 400 that may be performed by one or more components of system 100 and/or control system 150 in order to operate machine 102, for example, via remote operator control and via autonomous control. In an optional initial step 402, machine 102 and/or haul truck 106 are positioned (e.g., driven) to a dig site (e.g., dig site 112) on work site 110. For example, the operator(s) at remote control site 104 may tram or otherwise maneuver machine 102 to dig site 112. As mentioned, this driving or otherwise maneuvering of machine 102 may be performed using a non-LOS control, with the operator(s) relying on the one or more perception systems 134 or sensors on machine 102. Alternatively, the driving or otherwise maneuvering of machine 102 may be performed using LOS control, with the operator(s) being remote from machine 102 but within sight of machine 102. Moreover, driving haul truck 106 to dig site 112 may be done manually (e.g., via a truck operator in cab 136), or may be done remotely or autonomously. In some aspects, optional step 402 includes machine 102 calling haul truck 106, for example, via one or more signals from one or more communication device units 166 (e.g., honking a horn, flashing a light, etc.). Furthermore, in some aspects, optional step 402 may include the operator(s) defining a dig region, for example, forward of machine 102 in FIGS. 1A and 2. Additionally, in some aspects, optional step 402 may include the operator specifying a material (e.g., type of material like soil, sand, rock, etc.), a material angle of repose (e.g., an angle of descent of a dumped pile of material in bed 108 of haul truck 106), a target load, and/or other details of the material to be dug and dumped. These details may be input by the operator, for example, via user interface 128 and/or operator station 122.

With machine 102 and haul truck 106 positioned at dig site 112, in a step 404, the operator(s) may define the dump region. As mentioned above and as shown in FIG. 2, the operator(s) may define dump region 210 by positioning bucket 132 in a plurality of positions and storing the positions, for example, via user interface 128. For example, the operator(s) may position bucket 132 at front end point 30, for example, corresponding to first edge or end position 212, and store the position with one or more button-presses or other inputs (e.g., via user interface 128 and/or operator station 122). First end point 30 may correspond to a center (e.g., laterally central position in bed 108) of a rear-most dump point or a rear end of bed 108. The operator(s) may position bucket 132 at second end point 40, for example, corresponding to second edge or end position 214, and store the position with one or more button-presses or other inputs (e.g., via user interface 128 and/or operator station 122). Second end point 40 may correspond to a center (e.g., laterally central position in bed 108) of a front-most dump point or a front end of bed 108. The rear-most dump point and/or the front-most dump point may include accounting for the spread of dumped material in bed 108, for example, as material is dumped from bucket 132 onto bed 108.

In these aspects, positioning bucket 132 at the various positions may include the operator(s) controlling a joystick (e.g., of user interface 128) to control one or more of machine body 120, linkage assembly 130, and/or bucket 132 to position bucket 132. In some aspects, step 404 may include the operator(s) remotely controlling machine 102 to perform one dig (e.g., at dig site 112), and positioning bucket 132, as discussed above, with bucket 132 loaded with dug material. Moreover, in some aspects, control system 150 (e.g., controller 152) may extrapolate or interpolate a pose or orientation of haul truck 106, for example, of bed 108, which may include determining midline 220, for example, extending between first end position 212 and second end position 214.

In some aspects, step 404 may include dumping a first load of material. For example, the operator(s) may store the position of bucket 132 at first end point 30 (e.g., corresponding to rear-most end point D). The operator(s) may then store the position of bucket 132 at second end point 40 (e.g., corresponding to front-most end point C), and the operator(s) may then position bucket 132 in a middle position (e.g., between points C and D) and dump the first load of material (e.g., first dump position 330 in FIG. 3). In other aspects, the operator(s) may store the position of bucket 132 at first end point 30 (e.g., rear-most end point D). The operator(s) may then position bucket 132 in a middle position and dump the first load of material (e.g., first dump position 330). The operator(s) may then position bucket 132 in at second end point 40 (e.g., front-most end point C) and store the position to define dump region 210 between points C and D, with the first load of material in a middle position. In yet further aspects, the operator(s) may store the position of bucket 132 at first end point 30 (e.g., rear-most end point D). The operator(s) may then position bucket 132 in at second end point 40 (e.g., front-most end point C) and store the position to define dump region 210 between points C and D. The operator(s) may then dump the first load of material in a front position, for example, at front-most end point C.

Moreover, in some aspects, step 404 may include adjusting the dump region. For example, as mentioned above with respect to FIG. 3, in some aspects, controller 152 may adjust one or more end points of dump region 210 by an offset 350 (i.e., rear offset 350). As mentioned, controller 152 may determine rear offset 350 from the defined end positions, for example, an offset rear-most dump position D' from rear-most dump position D. Additionally, in some aspects, controller 152 may also determine an offset front-most dump position C' from front-most end point C. Front offset 360 from front-most end point C may be the same distance or spacing as rear offset 350, or may be different (e.g., larger or smaller). Rear offset 350 may be, for example, one foot, two feet, three feet, etc. from the defined dump position (e.g., from rear-most dump position D). In some aspects, a distance of rear offset 350 may depend on a type or a size of bed 108 and/or bucket 132. In other aspects, a distance of rear offset 350 may depend on the properties of the material being dug from dig site 112 and dumped into bed 108, for example, with a larger or more cohesive (e.g., harder or rockier) material corresponding to a smaller offset compared to a smaller or less cohesive (e.g., softer or sandier) material. Similarly, in other examples, a distance of rear offset 350 may depend on an angle of repose of the material being dug from dig site 112 and dumped into bed 108, for example, with material having a steeper angle of repose having a smaller offset and material with a less steep angle of repose having a larger offset.

Next, method 400 includes defining a dump order or dump specification in a step 406. Step 406 may include the operator(s) and/or controller 152 defining or selecting a dump order or dump specification from a list of a plurality of dump orders or dump specifications, for example, via user interface 128 and/or operator station 122. As discussed above with respect to FIG. 3, with dump region 210 defined, for example, by a line between points C' and D' (or between points C and D if one or more of offsets 350, 360 are needed), machine 102 may be operated autonomously to perform a digging and dumping procedure (e.g., in step 408), with the various dumps being spaced throughout dump region 210.

In some aspects, a first dump order or dump specification includes dumping successive loads from front-most dump position C or C' to rear-most dump position D or D'. For example, this dump order may be performed if the first load of material was dumped at front-most dump position C or C'. The next dump positions may be successively spaced toward rear-most dump position D or D'. For example, the spacing may be a fixed spacing (e.g., two feet toward the rear of bed 108 from a previous dump). Alternatively, the spacing may be an operator-specified spacing, for example, based on one or more of a size of bed 108, a size of bucket 132, a type of material being dug and dumped, etc. The operator-specified spacing may be consistent throughout a digging and dumping procedure, or may change between different haul trucks 106 (e.g., if a new haul truck 106 is brought to work site 110 after a bed 108 of a first haul truck 106 is full). Furthermore, the operator-specified spacing may change between successive or a group of dumps. Moreover, in some aspects, the spacing may be calculated (e.g., by controller 152), for example, based on the distance between front-most dump position C and rear-most dump position D or D', and dividing by an estimated total number of dumps. If a first dump has already been delivered, for example, to front-most dump position C, then the estimated total number of dumps may account for this initial dump by subtracting one from the estimated total number of dumps.

Additionally, in other aspects, the spacing between successive dumps may be variable, for example, based on a calculated weight and/or volume of material in bucket 132 to be dumped into bed 108. For example, controller 152 may receive data (e.g., from one or more of machine body sensor 154, linkage assembly sensor 156, bucket sensor 158, perception system(s) 134, and/or a payload monitoring system), and based on the received data, may calculate or otherwise determine a bucket load. For example, controller 152 may receive data from the payload monitoring system, which may include an inertial measurement unit (IMU), a hydraulic pressure sensor, and a bucket angle sensor, to determine the bucket load. In another aspects, controller 152 may determine the bucket load or payload amount via a strain gauge sensor. Controller 152 may then compare the determined bucket load to a target bucket load and/or to a target load for bed 108 to determine a variable spacing. For example, if bucket 132 is underloaded compared to the target bucket load, then the spacing from the previous dump position may be less than a nominal spacing. Alternatively, if bucket 132 is overloaded compared to the target bucket load, then the spacing from the previous dump position may be greater than the nominal spacing. Furthermore, controller 152 may compare the determined bucket load to the target load for bed 108 and/or target number of dumps. Similarly, if the determined bucket load is a larger percentage of the target load, then the spacing may be greater from the previous dump position. Similarly, if the determined bucket load is larger than an average bucket load for a target number of dumps, then the spacing may be greater from the previous dump position. In any of these aspects, a variable spacing may help evenly distribute the load of the dumped material in bed 108.

In other aspects, a second dump order or dump specification includes dumping successive loads in a bisecting pattern, as discussed within respect to FIG. 3. For example, the first dump may be in a bisecting or midway position (e.g., first dump position 330) of dump region 210 between front-most dump position C or C' and rear-most dump position D or D'. The second dump (e.g., second dump position 332) may be in either front-most dump position C or C', or rear-most dump position D or D', and the third dump (e.g., third dump position 334) may be in the other of front-most dump position C or rear-most dump position D or D'. The positions for the next dumps may be between (e.g., bisecting) previous dump positions. As mentioned above, fourth dump position 336 may be between (e.g., midway between) first dump position 330 and second dump position 332, and fifth dump position 338 may be between (e.g., midway between) first dump position 330 and third dump position 334. Additionally, further dump positions may be positioned between respective pairs of dumps (e.g., adjacent dump positions). Furthermore, in some aspects, when the midway position between adjacent dump positions falls below a threshold distance or value, controller 152 may reset the dump order or dump specification. As such, controller 152 may then again select dump positions from, sequentially, the midway position of dump region 210 (e.g., first dump position 330), the front-most dump position C or C' (e.g., second dump position 332), the rear-most dump position D or D' (e.g., third dump position 334), etc. to disperse or otherwise deliver one or more additional layers of material in bed 108, for example, on top of the first layer of material in bed 108. Moreover, in some aspects, one or more dump positions may be on one or more sides (e.g., left or right) of midline 220 of bed 108. For example, the dump order or dump specification may include alternating dump positions on the left or right side of midline 220. Furthermore, in some examples, each dump position (e.g., dump positions 330-338) may correspond to two dumps, with a first dump on one side of midline 220 and a second dump on another side of midline 220. In some aspects, step 404 may include one or more addition touchpoints to define the alternating dump positions and/or constraints on dump region 210. For example, step 404 may include positioning bucket 132 in one or more positions on one or more sides of midline 220, and storing the one or more positions of bucket 132 to further define dump region 210. Alternatively or additionally, step 404 may include the one or more operators defining sides of dump region 210 via user interface 128. In these aspects, the dump order or dump specification may help to distribute the load of the dumped material in bed 108, for example, over time so that bed 108 is loaded evenly during the digging and dumping procedure.

In some other aspects, a third dump order or dump specification includes dumping successive loads in a non-deterministic distributed order using variable loads. For example, controller 152 may determine dump region 210, as discussed above. For example, controller 152 may divide or otherwise separate dump region 210 (e.g., the area between positions C or C' and D') into fixed width bins or gridded volumes. Controller 152 may use the angle of repose of material on or to be delivered to bed 108 of haul truck 106 to assign fractional weights or volumes to each of the bins or areas. Controller 152 may also receive signals indicative of the load in bucket 132. Controller 152 may also track the position of one or more previous dump positions (e.g., with first dump position 330 being in a midpoint of dump region 210, second dump position 332 being a forward-most point of dump region, and third dump position 334 being a rear-most point of dump region). As such, controller 152 may model or otherwise project the flow and/or arrangement of dumped material in bed 108. In some aspects, controller 152 may monitor the material delivered to bed 108 (e.g., via one or more perception systems 134), and may include a stored soil model to simulate and/or predict the flow of dumped material during the dumping procedure (e.g., when performing an autonomous dumping procedure).

Based on the modeled or projected material in bed 108, controller 152 may identify or otherwise evaluate portions of bed 108 that are inadequately or deficiently loaded (i.e., not fully loaded). For example, controller 152 may determine or include a nominal spacing, for example, corresponding to load targets for each of the bins or areas of bed 108. Controller 152 may then signal one or more components of machine 102 to dump material from bucket 132 into portion(s) of bed 108 (e.g., bins or areas) that are the most deficient of dumped material (e.g., relative to the load targets for each bin or area). Moreover, controller 152 may evaluate a load of material in bucket 132. If the load is heavier or larger, controller 152 may signal machine 102 to dump material from bucket 132 into a very deficient portion of bed 108. Alternatively, if the load in bucket 132 is lighter or smaller, controller 152 may signal machine 102 to dump material from bucket 132 into a less deficient portion of bed 108. In some aspects, this dump order or dump specification may include delivering material more frequently (e.g., via more dumps of bucket 132) at positions closer to the front-most position C, for example, with a smaller spacing. The dump order or dump specification may include delivering material less frequently, for example, with successive dumps including larger spacings, at positions closer to the rear-most position D. In some aspects, the dump order or dump specification may include delivering less frequent dumps with each dump having a larger volume in the front portions or areas of bed 108, and delivering more frequent dumps with each dump having a smaller volume in the rear portions or areas of bed 108. In these aspects, bed 108 may be able to accommodate or otherwise receive larger volumes or weights in more forward portions than in more rearward portions.

In other aspects, the operator(s) could select a dump order or dump specification with no spreading between successive dump positions, or stationary dumps. In this aspect, each or a subset of dumps in the dump order or dump specification may be in the same dump position (e.g., first dump position 330 in a central portion of bed 108). Furthermore, in other aspects, the operator(s) could select a dump order or dump specification with spreading (e.g., spreading along midline 220 between points C or C' and D'). In this aspect, a first or previous dump position (e.g., first dump position 330) may be used as the center of the spread, for example, with or without some margin of error or range.

Furthermore, in a step 408, the operator(s) may initiate an autonomous digging and dumping procedure. As mentioned above, the autonomous digging and dumping procedure may be fully or partially autonomous. As discussed above, controller 152 may control one or more of machine body 120, linkage assembly 130, and bucket 132 to dig material from dig site 112. Moreover, controller 152 may control one or more of machine body 120, linkage assembly 130, and bucket 132 to deliver the dug material into dump region 210 (e.g., at least a portion of bed 108 of haul truck 106). The dug material may be delivered to dump region 210 according to the selected dump order or dump specification, as discussed above.

INDUSTRIAL APPLICABILITY

The present disclosure may be applicable in systems and methods for controlling an implement on a machine, such as, e.g., bucket 132 on machine 102, in order to deliver dug material into a transport machine, such as, e.g., haul truck 106. During operation, control system 150, including at least perception system(s) 134 and controller 152, and steps of method 400 may help to define dump region 210, for example, that spans at least a portion of bed 108 of haul truck 106. Aspects of control system 150, for example, perception system(s) 134 and/or controller 152, may be incorporated on machine 102, and may use one or more elements on machine 102. In these aspects, various aspects of this disclosure may be performed by one or more operators, for example, in a remote control operation mode. For example, the operator(s) may define dump region 210 and may select the dump order or dump specification. As such, there is no need to rely on perception system(s) 134 during the dumping procedure, especially since perceptions system(s) 134 may become obscured (e.g., by dust or other particulate) during the digging and dumping procedure.

Moreover, the dump orders or dump specifications, along with the corresponding autonomous dump planner, may help to ensure that material from bucket 132 is not dumped outside of dump region 210, for example, as defined by points C and D' during the autonomous digging and dumping procedure. Additionally, the autonomous dump planner discussed herein may help to coordinate the positions and/or movements of machine body 120, linkage assembly 130, and/or bucket 132 to help avoid material from bucket 132 being dumped outside of bed 108, for example, to the front, to the rear, or over the sides of bed 108. In some aspects, the autonomous dump planner may help to coordinate the positions and/or movements of machine body 120, linkage assembly 130, and/or bucket 132 to ensure that the far end or teeth of bucket 132 are positioned along midline 220 (e.g., the line between points C and D') of bed 108 to help ensure that the dumped material is delivered into bed 108.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It may be intended that the specification and examples be considered as exemplary only, with a true scope and spirit of the invention being indicated by the following claims.

What is claimed is:

1. A control system for a machine, comprising:

a machine body;

a linkage assembly;

a bucket coupled to the machine body via the linkage assembly;

a user interface remote from the machine body; and a controller in communication with the user interface, wherein the controller is configured to:

receive one or more signals defining a dump region, wherein the dump region includes a front-most end and a rear-most end, wherein receiving one or more signals defining the dump region includes positioning the bucket in the rear-most end of the dump region and positioning the bucket in the front-most end of the dump region, and wherein the rear-most end of the dump region is spaced from a rear-most end of a bed of a haul truck by an offset;

receive one or more signals defining a dump order or dump specification; and initiate an autonomous digging and dumping procedure.

2. The control system of claim 1, wherein the dump order or dump specification includes a first dump position in a midway point of the dump region, a second dump position in the front-most end of the dump region, and a third dump position in the rear-most end of the dump region.

3. The control system of claim 2, wherein the dump order or dump specification further includes dumping material in positions bisecting adjacent dump positions.

4. The control system of claim 1, wherein the dump order or dump specification includes a first dump position in the front-most end of the dump region, and successive dump positions spaced from the first dump position in a direction toward the rear-most end of the dump region.

5. The control system of claim 4, wherein the spacing between successive dump positions is determined based on a volume or a weight of a load in the bucket.

6. The control system of claim 1, wherein the dump order or dump specification includes modeling material dumped into a bed of a haul truck, and dumping successive loads in portions of the bed of the haul truck that are not fully loaded.

7. A method of operating a machine with a bucket, comprising:

defining a dump region, wherein defining the dump region includes positioning the bucket in a rear-most end of the dump region, storing the position with the bucket in the rear-most end of the dump region, then positioning the bucket in the middle of the dump region and dumping a load from the bucket in a first dump position, then positioning the bucket in a front-most end of the dump region, and storing the position of the bucket in the front-most end of the dump region;

defining or selecting a dump order or dump specification; and initiating an autonomous digging and dumping procedure.

8. The method of claim 7, wherein defining the dump region further includes moving an end of the dump region by an offset from one or more of the stored bucket positions.

9. The method of claim 7, wherein the dump order or dump specification includes the first dump position in the middle of the dump region, a second dump position in the front-most end of the dump region, and a third dump position in the rear-most end of the dump region.

10. The method of claim 9, wherein the dump order or dump specification further includes dumping material in positions bisecting adjacent dump positions.

11. The method of claim 7, further comprising, after positioning the bucket in the front-most end of the dump region, dumping a load from the bucket in the front-most end of the dump region.

12. The method of claim 11, wherein the dump order or dump specification includes the dump position in the front-most end of the dump region, and successive dump positions spaced from the dump position in the front-most end of the dump region in a direction toward the rear-most end of the dump region.

13. The method of claim 9, wherein a spacing between successive dump positions is determined based on a volume or a weight of a load in the bucket.

14. The method of claim 7, wherein the dump order or dump specification includes modeling material dumped into a bed of a haul truck, and dumping successive loads in portions of the bed of the haul truck that are not fully loaded.

15. A digging machine, comprising:

a machine body;

a linkage assembly;

a bucket movably coupled to the machine body via the linkage assembly;

at least one perception system on the digging machine, wherein one of the at least one perception system is positioned on the linkage assembly; and a controller in communication with the at least one perception system, wherein the controller is configured to:

receive one or more signals defining a dump region, wherein the dump region includes a forward-most end point and a rear-most end point, wherein receiving one or more signals defining the dump region includes positioning the bucket in a rear-most end of the dump region and positioning the bucket in a forward-most end of the dump region, and wherein the rear-most end point of the dump region is spaced from a rear-most end of a bed of a haul truck by an offset;

receive one or more signals defining a dump order or dump specification; and initiate an autonomous digging and dumping procedure.

16. The digging machine of claim 15, wherein the dump order or dump specification includes a first dump position in a midway point of the dump region, a second dump position in a front-most end of the dump region, and a third dump position in a rear-most end of the dump region, and wherein the dump order or dump specification further includes dumping material in positions bisecting adjacent dump positions.

17. The digging machine of claim 15, wherein the dump order or dump specification includes a first dump position in a front-most end of the dump region, and successive dump positions spaced from the first dump position in a direction toward the rear-most end of the dump region, and wherein a spacing between successive dump positions is determined based on a volume or a weight of a load in the bucket.

18. The digging machine of claim 15, wherein the dump order or dump specification includes modeling material dumped into a bed of a haul truck, and dumping successive loads in portions of the bed of the haul truck that are not fully loaded.

19. The digging machine of claim 15, wherein the spacing between successive dump positions is determined based on a volume or a weight of a load in the bucket.

20. The digging machine of claim 15, wherein the digging machine is an excavator, a rope shovel, a mining shovel, or a hydraulic shovel.

* * * * *